US006138888A

United States Patent [19]

Liao

[11] Patent Number: 6,138,888

[45] Date of Patent: Oct. 31, 2000

[54] PNEUMATIC HAMMER

[76] Inventor: Walter Liao, 1F, l, Alley 16, Lane 40, Jinn Te Rd., Taichung, Taiwan

[21] Appl. No.: 09/431,116

[22] Filed: Nov. 1, 1999

[51] Int. Cl.[7] ..... B25C 1/04

[52] U.S. Cl. ..... 227/130; 173/132

[58] Field of Search ..... 227/130, 10, 131; 173/132; 91/220

[56] References Cited

U.S. PATENT DOCUMENTS 3,434,643 3/1969 Wandel ..... 227/130
3,438,449 4/1969 Smith ..... 227/130
3,813,993 6/1974 Smith ..... 91/220
4,215,808 8/1980 Sollberger et al. ..... 227/130

*Primary Examiner*—Scott A. Smith

[57] ABSTRACT

A pneumatic hammer includes a piston rod extending from an aperture defined through the casing and a collar member is mounted to the piston rod and engaged with the aperture so as to limit the piston rod from shaking when the piston rod reciprocatingly moves. The collar member is easily removed from the aperture so as to mount a tube to the piston rod and a hammer head is therefore connected to the lower end of the piston rod.

4 Claims, 8 Drawing Sheets

PNEUMATIC HAMMER

FIELD OF THE INVENTION

The present invention relates to a pneumatic hammer, and more particularly, to an improved pneumatic hammer having a collar member removably mounted to the cylinder rod so as to engaged with an aperture in the lower casing such that the cylinder rod is moved without shaking.

BACKGROUND OF THE INVENTION

A conventional pneumatic hammer has to types of structure, one of which includes a casing with a cylinder received therein and the cylinder rod movably extends through the lower portion of the casing so that when the cylinder is activated, the cylinder rod moves reciprocatingly to hit an object. The other type of pneumatic hammer includes a casing with a cylinder received therein and the cylinder rod extends through the casing and a hammer head is connected to the cylinder rod. The hammer head is convenient for the user to hit nails into an object. In practical use, the hammer head and the cylinder rod are both useful so that the user has to disengage the casing to change parts in the pneumatic hammer so that the hammer head is able to be fixedly connected to the lower end of the cylinder rod. It takes a lot of time to disengage the casing to connect the hammer head to the cylinder rod.

The present invention intends to provide a pneumatic hammer which is easily to let a hammer head be connected to the cylinder rod without taking too much time. The pneumatic hammer of the present invention mitigates the disadvantages of the conventional pneumatic hammer.

SUMMARY OF THE INVENTION

In accordance with one aspect of the present invention, a pneumatic hammer is provided and comprises a casing having a neck extending therefrom and a cylinder received in the casing. A piston rod extending from the piston and extends through the neck. The casing has an aperture defined therethrough and the neck communicates with the aperture. The piston rod has a flange extending radially outward therefrom. A collar member is mounted to the piston rod and engaged with the aperture of the casing.

The main object of the present invention is to provide a pneumatic hammer having a collar member which is engaged with the aperture in the casing so that the piston rod extending through the aperture moves without asking.

Further objects, advantages, and features of the present invention will become apparent from the following detailed description with appropriate reference to the accompanying drawings.

DETAILED DESCRIPTION OF THE PREFERRED EMBODIMENTS

Figure 1:
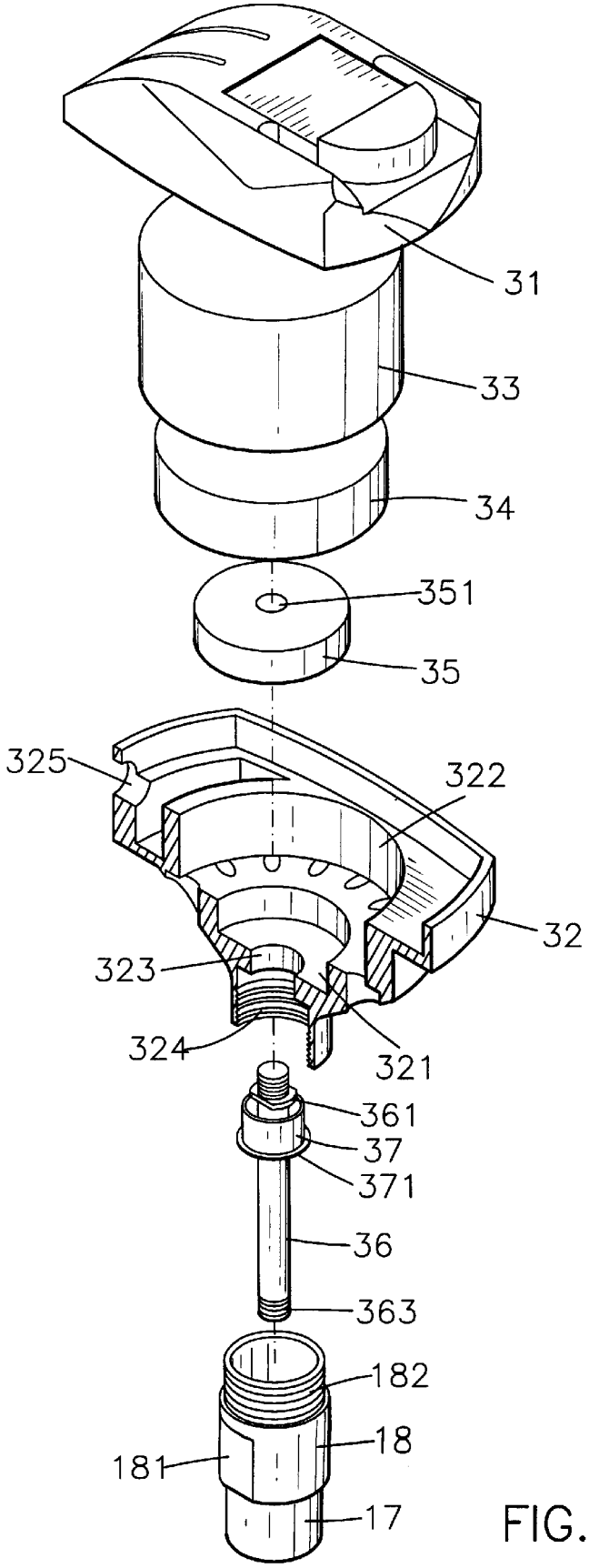
FIG. 1 is an exploded view of the pneumatic hammer in accordance with the present invention.
Figure 2:
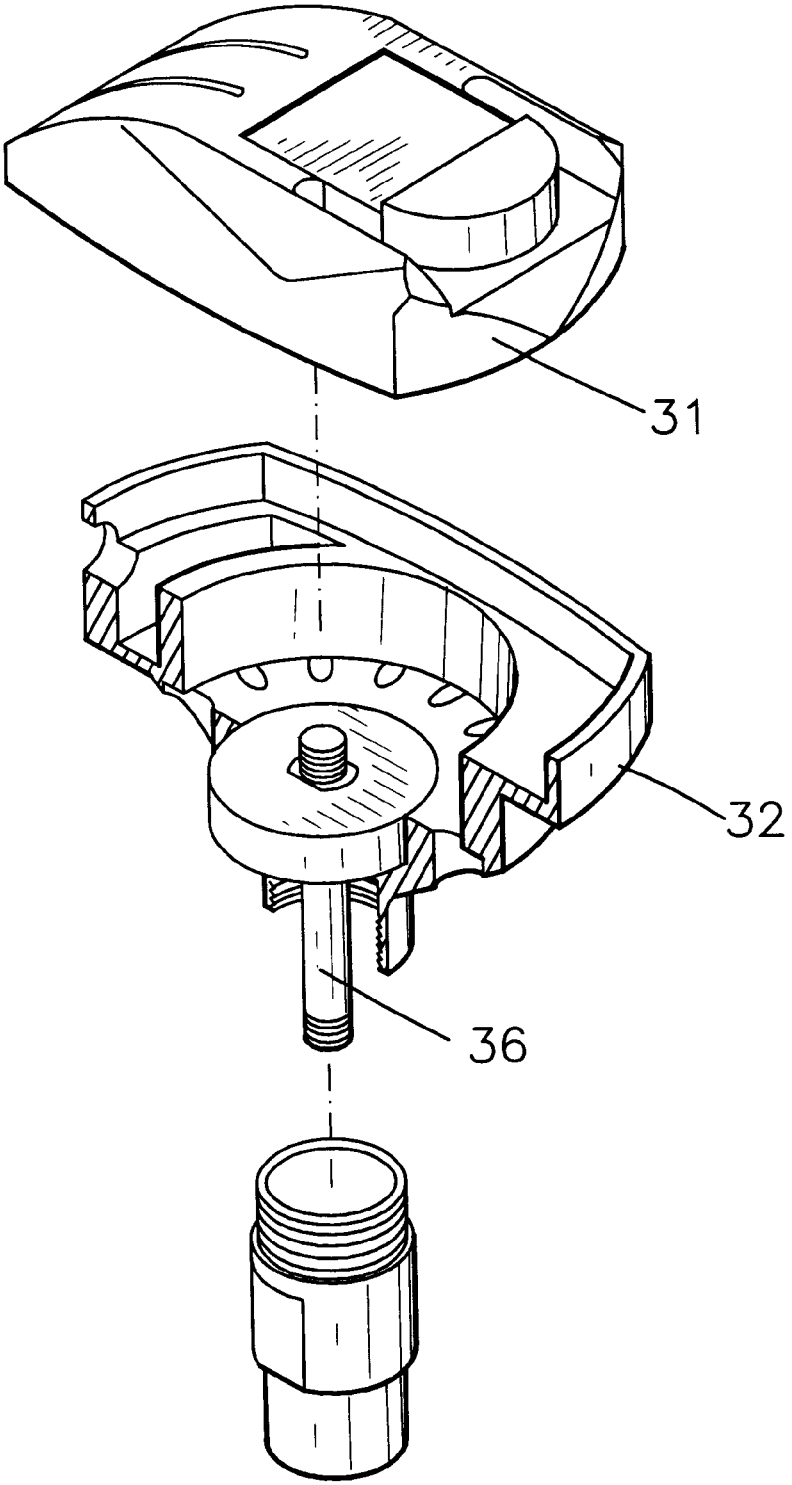
FIG. 2 is an exploded view of the casing, the piston with the piston rod and the sleeve of the pneumatic hammer in accordance with the present invention.
Figure 3:
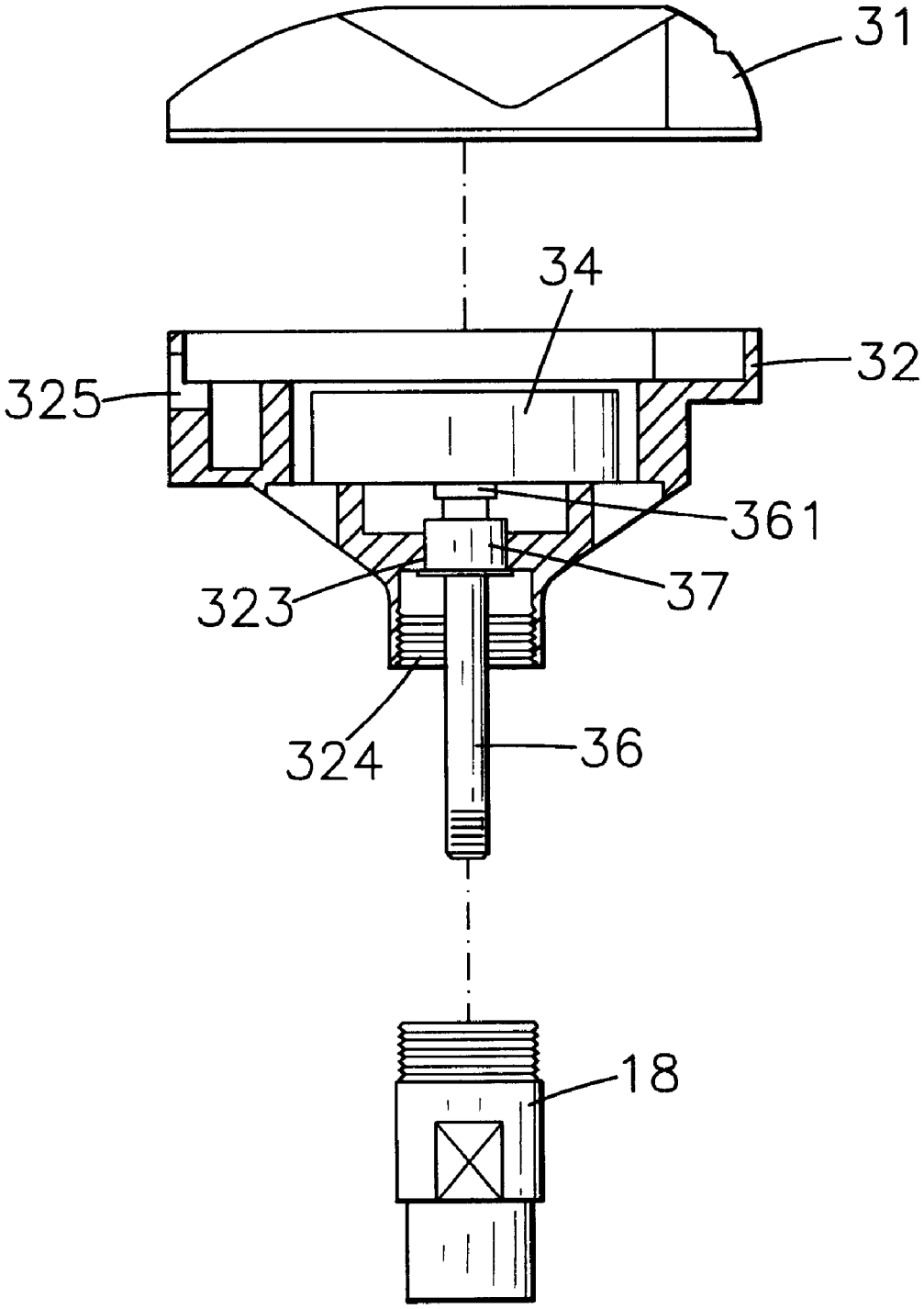
FIG. 3 is a plan view of the parts shown in FIG. 2.
Figure 4:
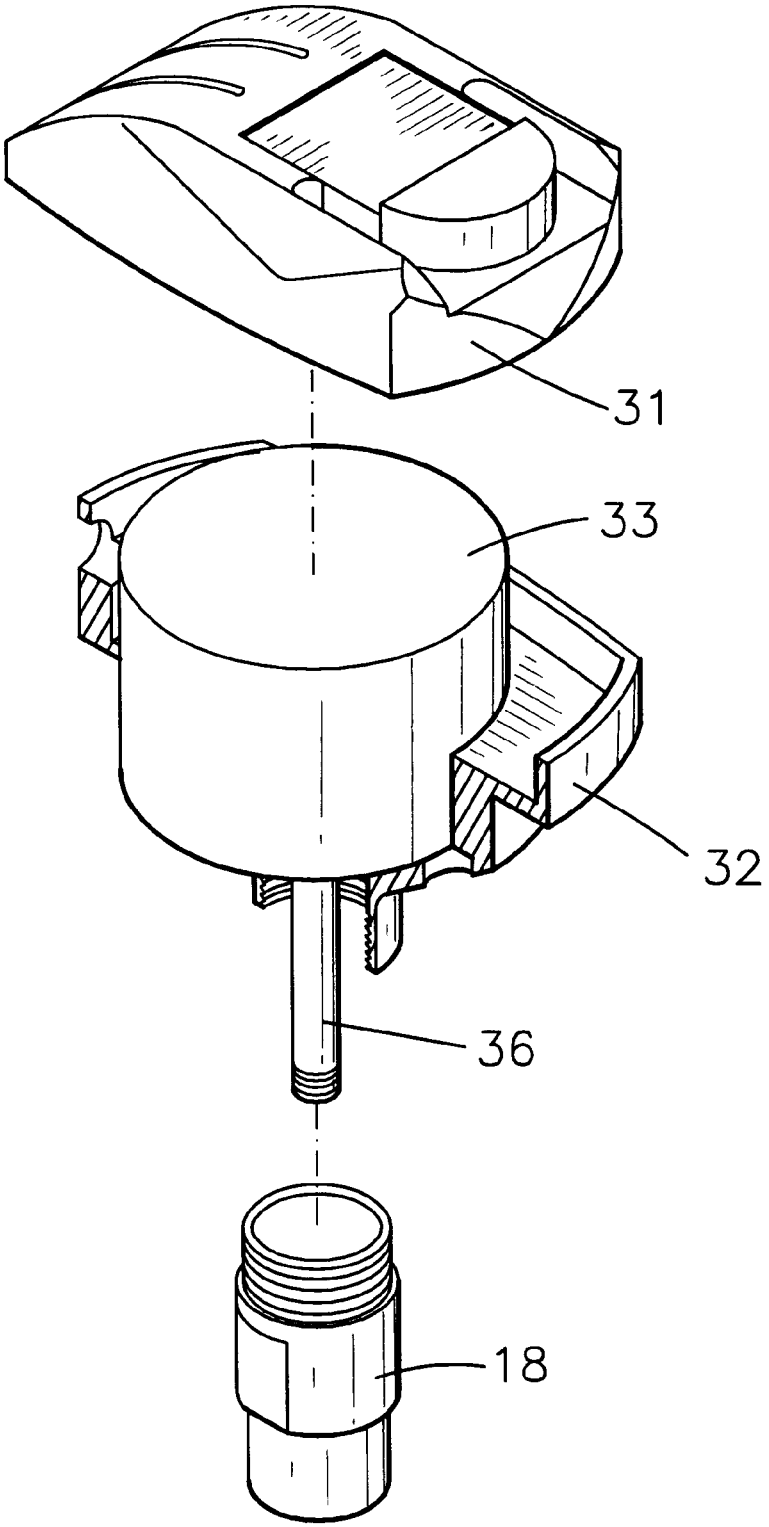
FIG. 4 is an exploded view of the casing, the cylinder and the sleeve of the pneumatic hammer in accordance with the present invention.
Figure 5:
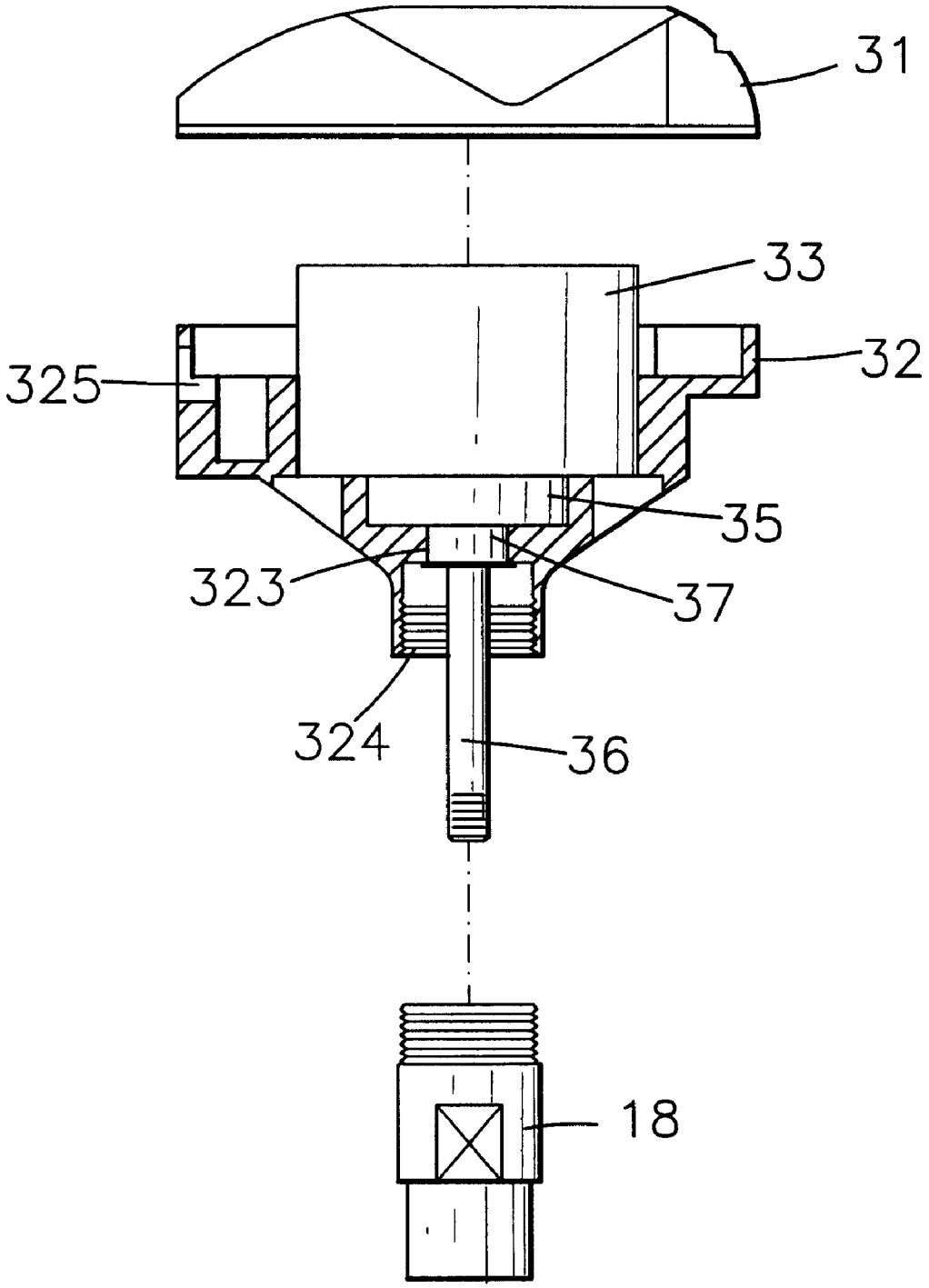
FIG. 5 is a plan view of the parts shown in FIG. 4.

Referring to FIGS. 1 to 5, the pneumatic hammer of the present invention comprises a casing which is composed of a first part 31 and a second part 32, wherein an air inlet 325 is defined radially through the second part 32. The second part 32 has a first chamber 322 and a second chamber 321 which shares a common axis with the first chamber 322. A neck 324 extends from the second part 32 and an aperture 323 is defined through the second part 32. The neck 324 has a threaded inside and communicates with the aperture 323. A cylinder 33 is received in the first chamber 322 and a piston 34 is movably received in the cylinder 33. A piston rod 36 extends from the piston 34 and through a hole 351 through a pad 35 received in the second chamber 321, and the neck 324. The piston rod 36 has a flange 361 extending radially outward therefrom. The piston rod 36 has a threaded portion 363 defined in the lower end thereof.

A collar member 37 is mounted to the piston rod 36 and engaged with the aperture 323 of the second part 32. The collar member 37 has a flange 371 so that the flange 371 is engaged with the lower end of the aperture 323 such that the piston rod 36 will not shake when reciprocatingly moves.

A sleeve 18 is mounted to the piston rod 36 and one end of the sleeve 18 has a threaded section 182 which is fixedly engaged with the neck 324. A extension portion 17 extends from the sleeve 18 so that the piston rod 36 is enclosed by the sleeve 18 and the extension portion 17 such that the user's finger will not be injured by the moving piston rod 36. The sleeve 18 has two plain surfaces 181 so that the sleeve 18 can be clamped by a tool such as a spanner.

Figure 6:
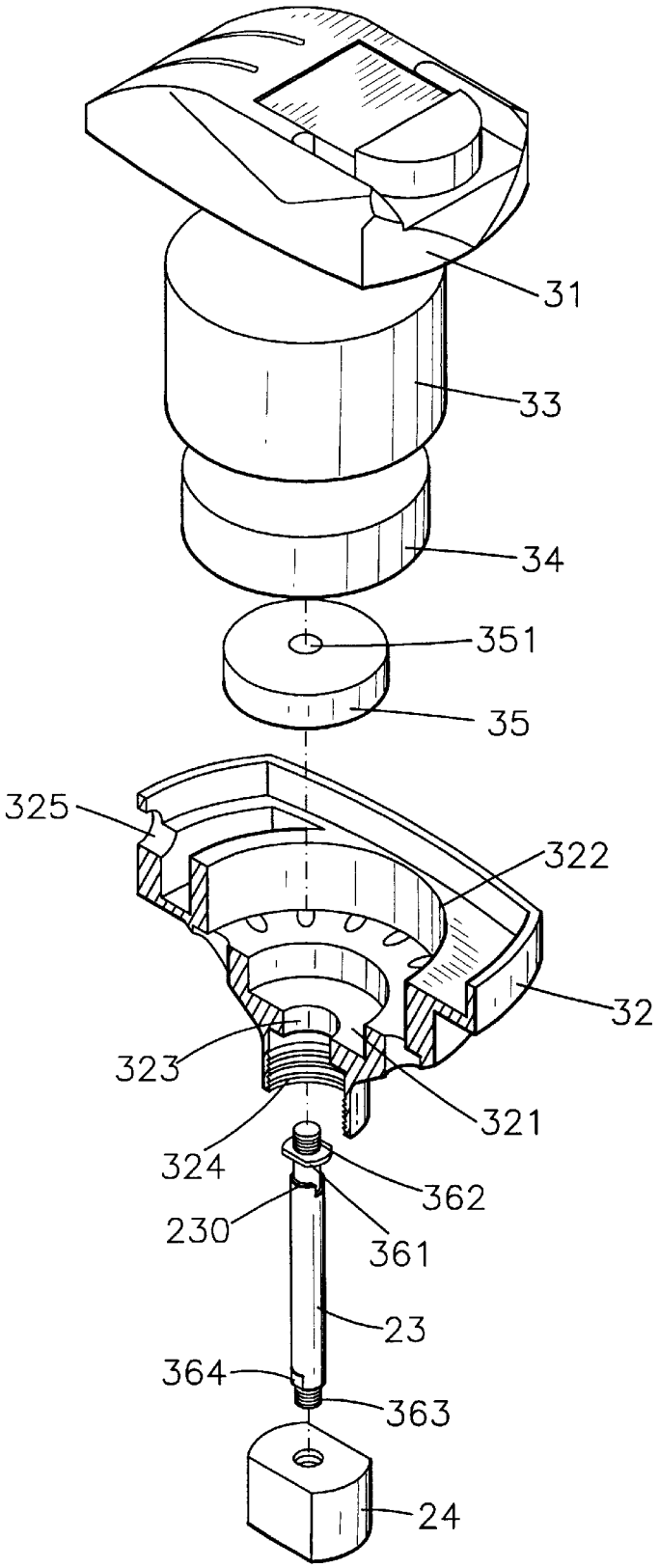
FIG. 6 is an exploded view of the casing, the cylinder, the tube mounted to the piston rod and the hammer head in accordance with the present invention.
Figure 7:
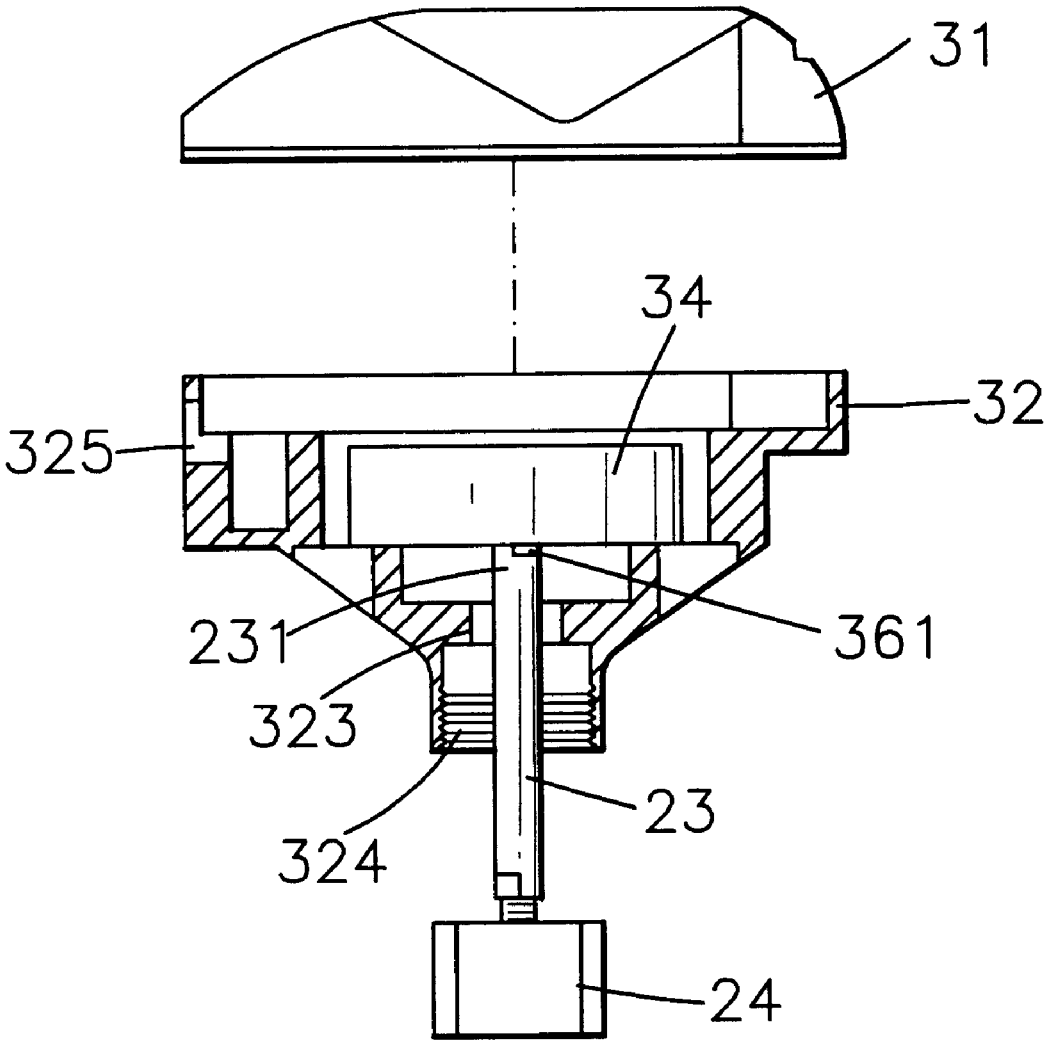
FIG. 7 is a plan view to show the hammer head connected to the piston rod extending from the piston.
Figure 8:
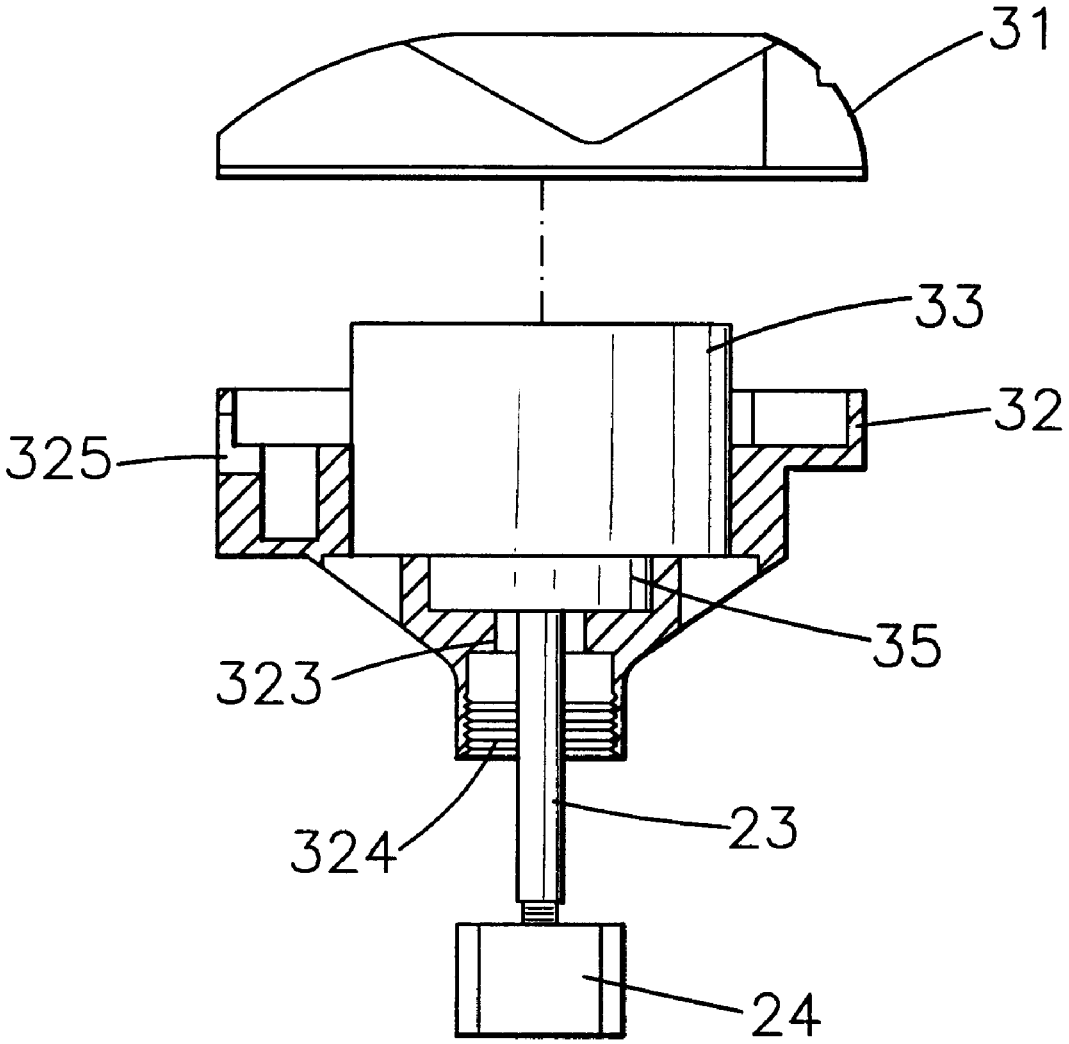
FIG. 8 is a plan view to show that the piston as shown in FIG. 7 is received in the cylinder.

Referring to FIGS. 6 to 8, when a hammer head 24 is to be connected to the piston rod 23, the collar member 37 is removed from the piston rod 36 and a tube 23 is mounted to the piston rod 36. The tube 23 has two lugs 230 extending from one of two ends thereof and the flange 361 of the piston rod 36 has two plain sides which are engaged with the two lugs 230. Therefore, the user may use a spanner to clamp the two plain surfaces 364 and the other spanner to connect the hammer head 24 to the threaded portion 363 of the piston rod 36. Because the two lugs 230 are engaged with the flange 361 of the piston rod 36 so that the piston rod 36 will not co-rotate with the hammer head 24 which is then easily connected to the piston rod 36.

The collar member 37 ensures that the piston rod 36 is moved in stable and will not shake within the aperture 323. The collar member 37 is easily removed from the assembly so as to mount the tube 23 to the piston rod 36 and the hammer head 24 is easily connected to the piston rod 36.

The invention is not limited to the above embodiment but various modification thereof may be made. It will be understood by those skilled in the art that various changes in form and detail may made without departing from the scope and spirit of the present invention.

What is claimed is:

1. A pneumatic hammer comprising:

a casing having a neck extending therefrom and an aperture defined through said casing, said neck communicating with said aperture, a cylinder received in said casing and a piston movably received in said cylinder, a piston rod extending from said piston and through said neck, said piston rod having a flange extending radially outward therefrom, and a collar member mounted to said piston rod and engaged with said aperture of said casing.

2. The pneumatic hammer as claimed in claim 1 further comprising a sleeve mounted to said piston rod and one end of said sleeve is fixedly engaged with said neck.

3. The pneumatic hammer as claimed in claim 1 further comprising a tube mounted to said piston rod and having two lugs extending from one of two ends thereof, said flange having two plain sides which are engaged with said two lugs.

4. The pneumatic hammer as claimed in claim 3, wherein said piston rod is connected to a hammer head.

* * * * *